United States Patent [19]

Kagehiro

[11] Patent Number: 4,492,050

[45] Date of Patent: Jan. 8, 1985

[54] SHOTGUN RECOIL REDUCER

[76] Inventor: Ken Kagehiro, Rte. 1, Colusa, Calif. 95932

[21] Appl. No.: 484,215

[22] Filed: Apr. 12, 1983

[51] Int. Cl.[3] ..... F41C 21/18

[52] U.S. Cl. ..... 42/1 V

[58] Field of Search ..... 42/1 V; 89/198

[56] References Cited

U.S. PATENT DOCUMENTS

| | | | |
|---|---|---|---|
| 2,679,192 | 5/1954 | Seeley et al. | 42/1 V |
| 3,018,694 | 1/1962 | Browning | 42/1 V |
| 3,105,411 | 10/1963 | Browning | 42/1 V |
| 3,115,063 | 12/1963 | Browning | 42/1 V |
| 4,088,057 | 5/1978 | Nasypany | 42/1 V |
| 4,156,979 | 6/1979 | Katsenes | 42/1 V |

*Primary Examiner*—Charles T. Jordan

*Attorney, Agent, or Firm*—Owen, Wickersham & Erickson

[57] ABSTRACT

A recoil reducer can be fitted onto most styles of conventional shotguns with very simple modification. An elongated cylinder tube is slipped into the end of the gun's magazine tube, the rear portion of the cylinder tube being a reinforcing sleeve which lines the interior of the magazine tube for a distance to add strength to the magazine tube and stability to the cylinder tube, the forward end of the cylinder tube extending beyond the end of the magazine. A threaded coupling on the exterior of the cylinder tube is tightened onto the threaded end of the magazine tube to secure the cylinder tube in place. Inside the cylinder tube is a slidable, weighted piston assembly, biased by a spring toward the forward end of the cylinder tube, and an expansible chamber which receives pressurized gases from the gun barrel when a round is fired, thereby pushing the piston assembly rearward against the biasing of the spring, causing the gun to recoil in the forward direction and partially offsetting the rearward recoil of the gun from the firing of the round. A barrel ring extending down from the barrel encircles the gun's magazine tube just back from the threaded end, and a bore from the ring to the interior of the gun barrel is aligned with bores through the magazine tube and the sleeve of the recoil cylinder tube, so that the pressurized gases from the firing of the round are conducted into the expansible chamber. The cylinder tube of the recoil device preferably includes a removable threaded cap on its forward end, and a buffer just inside the cap, against which the forward end of the piston assembly normally rests and against which it impacts when the piston assembly is returned forward by the spring.

13 Claims, 7 Drawing Figures

SHOTGUN RECOIL REDUCER

BACKGROUND OF THE INVENTION

The invention relates to firearms, and more particularly to a recoil reducer device which may be fitted onto most conventional shotguns with very little modification.

Gas-operated shotgun recoil reducers have been known previously. For example, U.S. Pat. No. 4,088,057 issued to Nasypany disclosed a gas-operated recoil reducer mounted on top of a gun barrel, connected thereto by a bracket as shown in FIG. 6 of the patent. The operation of that recoil reducer was somewhat similar to that of the present invention, in that gas pressure from the explosive charge was operative to push a piston back to the rear of a cylinder tube. The piston was slowed down in a damping effect, with bleeding of gas pressure at the rear of the cylinder.

Another item of prior art pertinent to this invention is the Remington Model 870 Competition Trap shotgun, as described, for example, in the article "Remington 870 Competition Trap", by Richard Kay, *Shootin' Trap* magazine, Volume 3, Number 5, July 1981, pages 42–48. That shotgun again utilized the same principle as in the present invention, that of reducing recoil by pushing a piston assembly backward with expanding gases from the exploded charge. However, the Remington recoil reducer was integral with the gun, not capable of being added onto an existing shotgun, and eliminated any magazine storage for the gun, limiting shell storage to the one shell loaded in the chamber.

U.S. Pat. Nos. 2,679,192 (Seeley et. al) and 4,156,979 (Katsenes) also show gas-operated recoil reducers, but each works on a theory which is opposite from that of the Remington gun and of the present invention. In the Seeley and Katsenes patents, gas from the explosive charge was employed to push a piston weight forwardly in a tube, and the weight's striking the forward end of the tube was the reaction which supposedly opposed the normal gun recoil to reduce it.

U.S. Pat. Nos. 3,115,063 (Browning) 3,105,411 (Browning), 3,683,534 (Davis), and 3,461,589 (Vironda) all show devices aimed at recoil reduction but not involving gas operation, with little pertinence to the present invention.

None of the prior art provided or contemplated a relatively simple, explosive-gas-operated shotgun recoil reducer device which can be added to an existing shotgun of nearly any conventional configuration, with very little modification required. This is accomplished with the present invention described below.

SUMMARY OF THE INVENTION

According to the present invention, a recoil reducer for attachment to a shotgun of conventional design includes a cylinder tube which attaches to the gun as an extension for the forward end of the magazine tube, including a rearward-extending reinforcing sleeve which fits closely inside the magazine tube and a forward extension connected to the sleeve. A threaded ring is positioned on the exterior of the cylinder tube for engaging the threaded forward end of the gun's magazine tube, for securing the cylinder tube to the magazine tube such that the reinforcing sleeve extends into the magazine tube for stability of the cylinder tube and added strength for the magazine tube. Inside the cylinder tube is a slidable piston weight, with means biasing it in the forward direction. An expansible chamber is formed in the cylinder tube adjacent to the forward end of the piston weight, and there are gas conducting means for admitting pressurized gases generated upon the firing of a round in a shotgun, from the barrel to the expansible chamber to move the piston weight rearwardly against the biasing means. Thus, when a round is fired in the shotgun, pressurized gases from behind the fired shot are admitted from the barrel to the expansible chamber in the cylinder tube, pushing the piston weight rearwardly and thereby recoiling the shotgun forward to partially offset the recoil from firing of the round.

Preferably, the piston assembly includes a rod, connecting the piston weight to a forward slidable weight attached at the forward end of the rod. A fixed block is positioned in the cylinder tube between the two weights with a bore through which the rod is slidable, forming a wall of the expansible chamber. The biasing means preferably comprises a compression spring positioned around the rod and between the fixed block and the forward slidable weight. Both weights preferably are lead-filled.

The recoil reducer device of the invention utilizes the gun's barrel ring for communicating the pressurized gases from an explosive charge in the barrel to the expansible chamber, via a gasport bore from the ring into the barrel, aligned with bores through the magazine tube and the sleeve inside. On many shotguns of contemporary design, the gasport bore through the barrel ring and magazine tube is the only modification required to the gun for addition of the recoil reducer.

The recoil reducer of the invention can also be fitted to semiautomatic shotguns, and shotguns having slightly different magazine tube arrangements than the conventional Remington standard pump shotgun, with slight additional modifications.

It is among the objects of the invention to improve over recoil reducing implements suggested in the prior art by providing a device which is effective in greatly reducing recoil, while being capable of retrofitting to nearly all conventional shotgun configurations. These and other objects, advantages, features and characteristics of the invention will be apparent from the following description of a preferred embodiment, considered along with the accompanying drawings.

DESCRIPTION OF PREFERRED EMBODIMENTS

Figure 1:
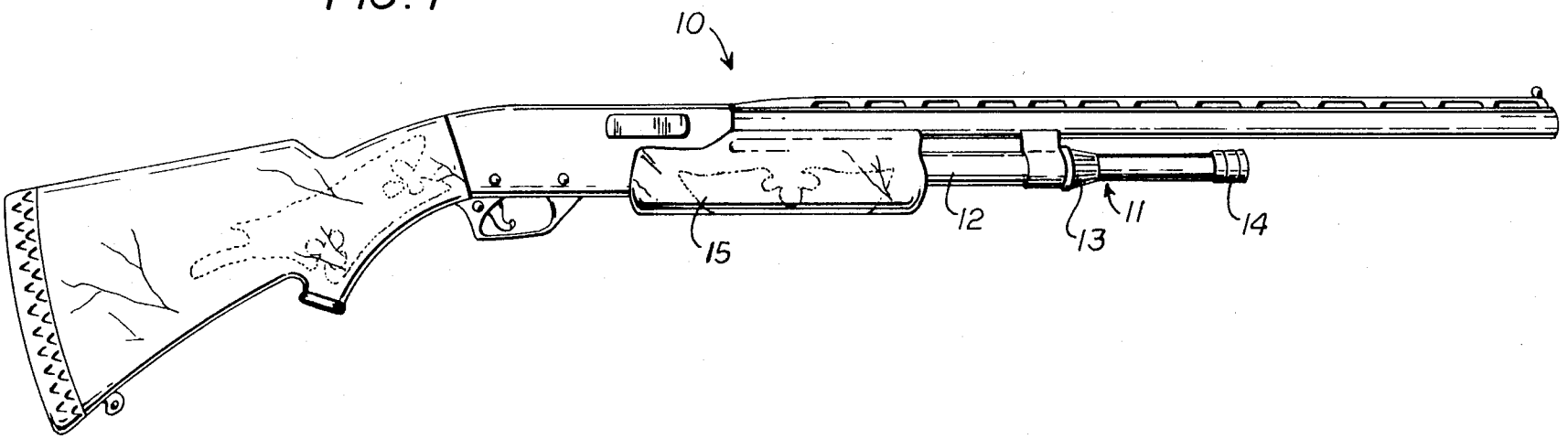
FIG. 1 is a side elevational view of a conventional shotgun to which a recoil reducer according to the invention has been added.

In the drawings, FIG. 1 shows a shotgun 10 of conventional design, for example a Remington 870 standard pump shotgun. The shotgun 10 could also be a Winchester shotgun or one of similar design from other manufacturers. Fitted onto the shotgun 10 is a recoil reducer device 11 according to the present invention, extending into the gun's existing magazine tube 12 and having a threaded cap-like sleeve member 13 which screws onto the threaded end of the magazine tube 12. A threaded cap 14 closes the forward end of the recoil reducer device. The gun 10 is shown with its forearm 15 pulled back.

The addition of the recoil reducer 11 will reduce the magazine storage of a shotgun 10 from four cartridges to two.

Figure 2:
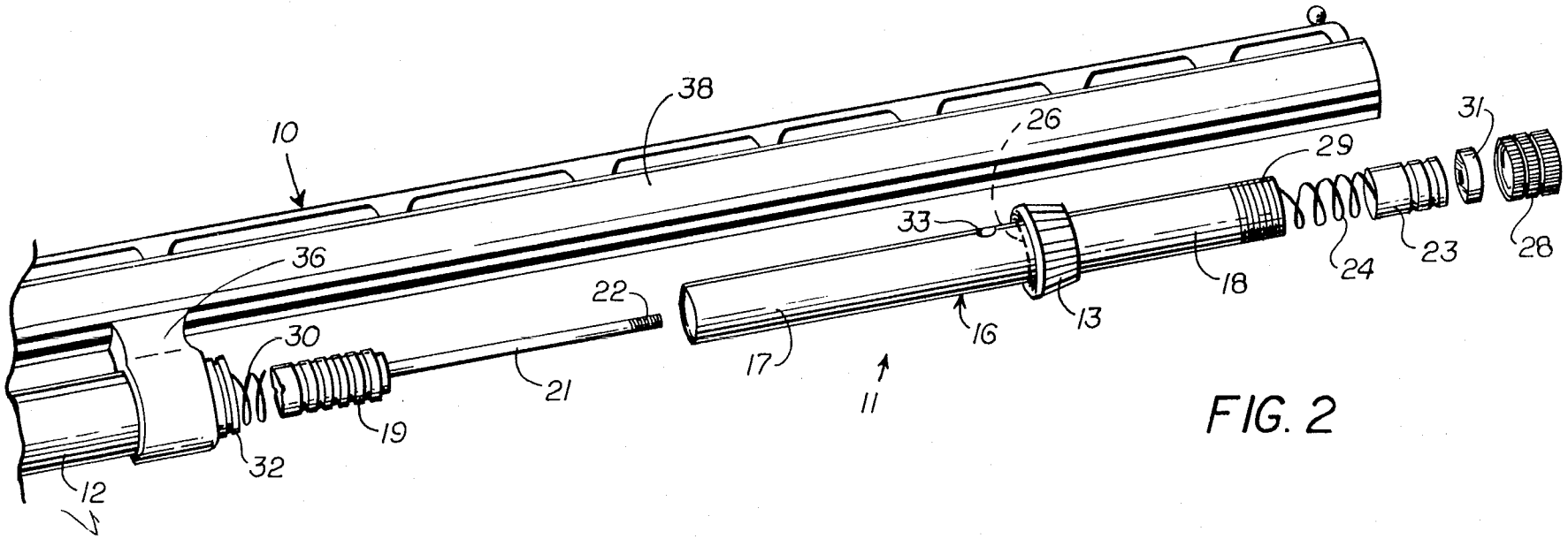
FIG. 2 is a view in perspective showing the forward portion of the gun barrel and magazine tube, and illustrating in exploded view the components of the recoil reducer assembly.

FIG. 2 shows the recoil reducer device 11 in exploded view, indicating its various components and manner of assembly, and the manner of assembly to the magazine tube 12 of the shotgun. The recoil reducer assembly 11 includes an elongated cylinder tube 16 having a rearward-extending reinforcing sleeve 17 and a forward extension 18 which projects forward from the magazine tube 12. A piston weight 19 is connected to a rod 21, which has a threaded forward end 22 as shown. Upon assembly, the rod end 22 is screwed into a forward slidable weight 23, and a compression spring 24 is positioned over the rod 21, bearing against the forward slidable weights 23 to urge the entire piston assembly toward the front of the cylinder tube 16. Inside the tube 16 is a fixed block 26 (indicated by dashed line in FIG. 2—see also FIGS. 3 and 4), with a central hole through which the rod 21 passes, forming an expansion chamber 27 (see FIGS. 3 and 4) and providing a stop against which the back end of the compression spring 24 bears. Forward of the slidable weight 23, there is an end cap 28 which preferably connects to the cylinder tube 16 by threaded connection, being screwed onto a threaded end 29 of the cylinder tube. There is also preferably included a buffer 31, as of nylon, for example, held just inside the cylinder tube 16 by the cap 28, and against which the forward slidable weight 23 rests in normal position and impacts when the spring 24 returns the piston assembly to the forward position, shown in FIG. 3.

The spring 24 is assisted by the gun's magazine spring 30, which also acts in compression to urge the piston forward.

Figure 3:
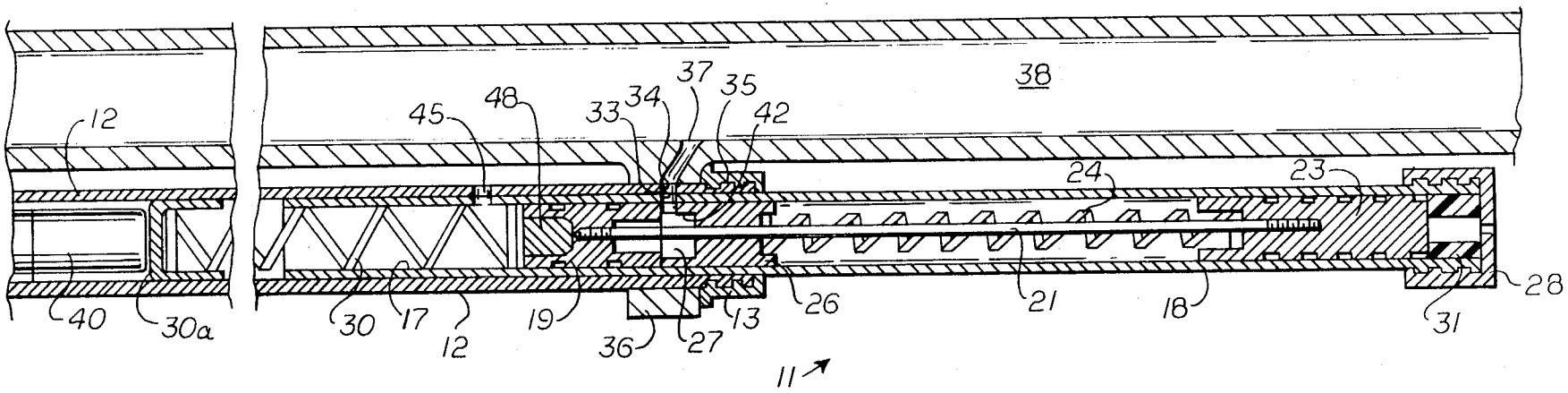
FIG. 3 is a partial side elevation view in section showing the apparatus of the invention on the shotgun, with the internal piston assembly in its normal, rest position before a shot is fired.
Figure 4:
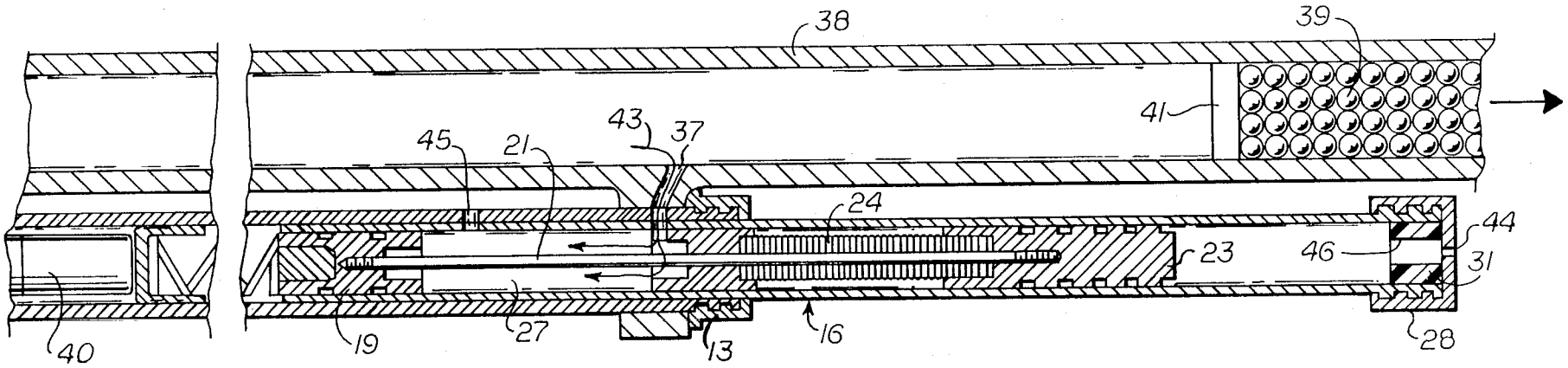
FIG. 4 is a view similar to FIG. 3, but showing the device with the piston assembly in a rearward position, having been forced back by pressurized gases from the explosive charge.

As can be seen from FIGS. 2, 3 and 4, once the piston assembly has been secured inside the cylinder tube 16, with the rod 21 screwed into the forward slidable weight 23, the rearward sleeve 17 of the device's cylinder tube 16 is slipped inside the magazine tube 12 of the shotgun, fitting closely inside the magazine tube, and the threaded sleeve member 13 is screwed onto the threaded forward end 32 of the magazine tube, as typically provided on conventional shotguns. A hole 33 in the upper side of the cylinder tube 16 is positioned to coincide with a hole 34 in the top of the magazine tube (FIGS. 3 and 4), drilled for this purpose, and an indicator (not shown) may be provided on the sleeve member 13 or the threads 35 may terminate such that alignment is assured when the recoil reducer is screwed into place. The aligned openings 33 and 34 are within a barrel ring 36 typically provided to engage the forward end of the magazine tube; and a gasport bore 37 (FIGS. 3 and 4) is specially drilled from the barrel ring 36 up into the barrel 38 of the shotgun, aligned with the holes 33 and 34 so that the expansion gases communicate with the expansible chamber 27.

FIGS. 3 and 4 show the positions of the slidable piston assembly before a shot is fired and just after firing, with the shot 39 progressing out of the barrel 38 and the wad 41 at the back of the shot. In the normal position, as shown in FIG. 3, the piston weight 19 is forward, just back from the aligned openings 33, 34 and 37 as shown, forming the back boundary of the expansible chamber 27. The piston assembly may be held in this position by a thin sleeve or stop member 42 comprising an extension of the fixed block 26, as shown in FIGS. 3 and 4, or it may simply rest against the buffer 31 at the forward end of the cylinder tube. As FIG. 3 illustrates, the gun's magazine spring 30 bears at its back end against a follower 30*a*, which bears against a shotgun shell 40 (of which there may be two) stored in the magazine tube 12. The front end of the magazine spring 30 engages the piston weight 19 to help urge it forward. On the gun 10 without the recoil reducer 11, the gun's magazine spring 30 would act between the shell 40 and a cap 28 screwed on the threads 35 at the front end of the magazine tube 12. Typically, two additional shells 40 could thereby be stored in the magazine—four instead of two.

When a round has been fired, and the shot 39 and wad 41 advance beyond the gasport 37 of the barrel, as shown in FIG. 4, pressurized gases (indicated by arrow 43) rush into the expansible chamber 27 and expand it to push the piston weight 19 back, and with it the rod 21 and forward slidable weight 23. The reinforcing sleeve 17 helps the magazine withstand the force of the highly pressurized gases entering the expansible chamber. The tension of the spring 24, together with the milder influence of the gun's magazine spring 30, is preferably such that, for a shell of normal powder charge, the piston assembly will recede to the point that the spring 24 is fully compressed, as shown in FIG. 4, and the spring thus limits rearward movement. Vent holes 44 and 46 are provided in the end cap 28 and the buffer 31, respectively, so that the forward slidable weight 23 can freely retract in the cylinder tube 16. When the piston assembly then returns, under the force of the compression spring 24, air is vented back out the vent holes 46 and 44. Vent holes 45 may also be included as shown in FIGS. 3 and 4 through the magazine tube 12 and sleeve 17, behind the normal position of the piston weight 19, for venting the expansion gases following piston retraction. This helps facilitate return of the piston assembly, but even without the holes 45 the gases can escape through the gasport 37 and the gun barrel 38.

FIG. 4 shows that the gun's magazine spring 30 is partially but not fully compressed when the piston assembly is fully retracted.

The piston weight 19 and forward slidable weight 23 may be hollow and filled with lead 48, so that they can have the desired mass without being of excessive length.

At the instant when the pressurized gases enter the expansible chamber to push the piston back, the recoiling of the gun is in progress, and the pushing back of the piston offsets the normal recoil by recoiling the gun in the forward direction, greatly reducing normal recoil.

Figure 5:
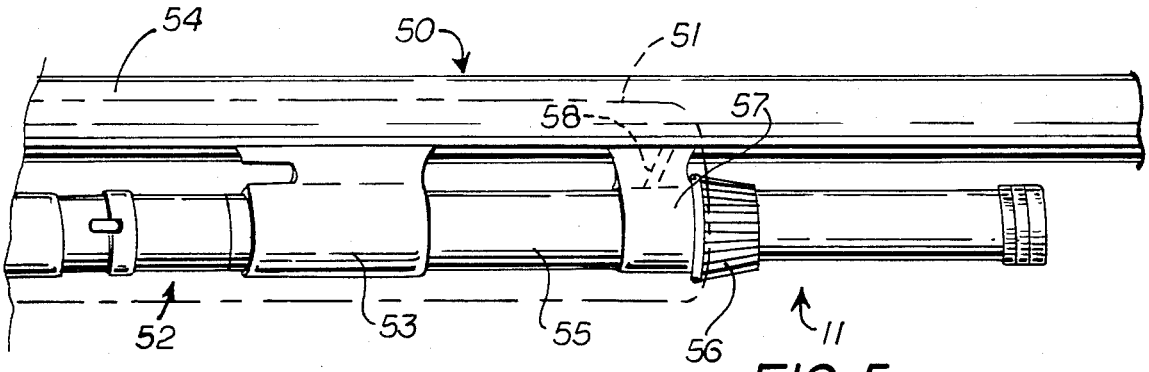
FIG. 5 is a partial view in side elevation showing the recoil reducer of the invention as incorporated on a semiautomatic shotgun.
Figure 6:
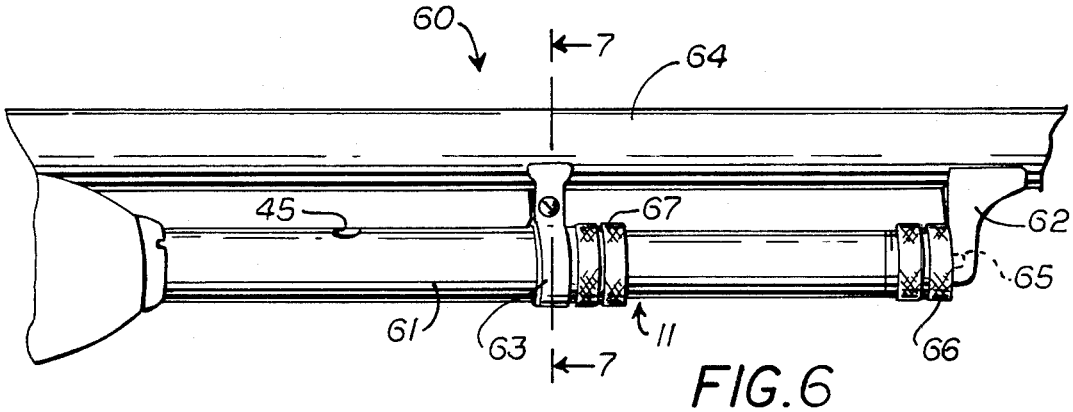
FIG. 6 is a partial view in side elevation showing the recoil reducer of the invention as incorporated on a shotgun of slightly different configuration.
Figure 7:
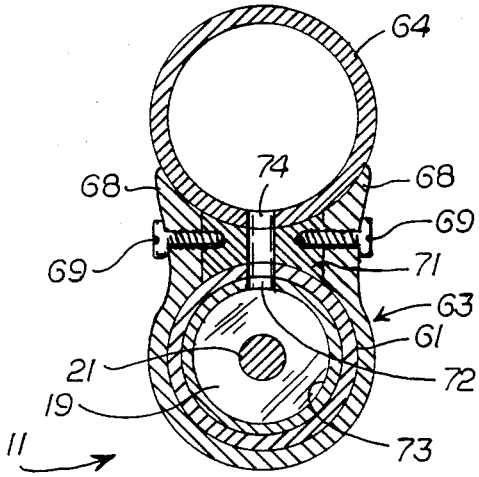
FIG. 7 is a sectional view as seen along the line 7—7 in FIG. 6.

FIGS. 5, 6 and 7 show the recoil reducer device 11 of the invention as incorporated on some different types of shotguns. In FIG. 5, the device is shown with a semiautomatic shotgun 50, for example a Remington 1100 semiautomatic. A wooden forearm 51 is shown only in dashed lines, to show some of the components of a gas-operated cartridge feeding mechanism 52. As is typical, such a semiautomatic shotgun includes a gas cylinder or ring 53 secured to the lower side of the barrel 54, for communicating expanding gases to the feeding mechanism 52. The magazine tube 55 extends to a position as indicated, and in the unmodified gun would have a magazine end cap (not shown) at the position where a threaded sleeve 56 is shown in the modified gun of FIG. 5. For the addition of the recoil reducer device of the invention to such a semiautomatic shotgun, the barrel 54 must be modified by adding a barrel ring 57 to it as shown, forward of the gas cylinder 53, with a gasport bore 58 (dashed lines) drilled as in the previous embodiment. These are the only modifications that need be made, and as in the adaptation described above, the magazine storage of the gun is reduced from four cartridges to two.

FIGS. 6 and 7 show the recoil reducer device 11 of the invention as adapted to a shotgun 60 of slightly different configuration, such as an Ithaca shotgun. In the Ithaca, the unmodified gun normally does not include a barrel ring secured to the barrel—only a clamp type barrel ring which engages against the bottom of the barrel for stabilizing the position of the magazine tube 61 and preventing it from rotation with respect to the barrel. A take-down bracket, similar to a take-down bracket 62 shown on the modified assembly of FIG. 6, would normally help hold the barrel 64 stable with respect to the magazine tube 61, with a pin of the magazine tube end cap extending into a hole in the bracket 62 (the unmodified configuration is not shown). For adaptation of the present invention to the Ithaca type shotgun, the take-down bracket 62 must be removed from its normal position. It may be eliminated entirely, since a barrel ring 63 is added, secured to the barrel 64 as a position stabilizer between the barrel 64 and the magazine tube 61, with the recoil reducer device 11 extending forward therefrom. However, as indicated in FIG. 6, the take-down bracket 62 may be moved forward and re-secured to the barrel 64 (as by silver soldering), to engage a forward end cap 66 on the recoil reducer assembly 11, with a pin 65, in the same way it would engage the end cap on the the unmodified Ithaca. As in the other embodiments, a threaded sleeve 67 on the recoil reducer 11 screws onto the threaded end of the Ithaca's magazine tube 61. This is done with the barrel removed. When the barrel 64 is then put in place, the take-down bracket 62 engages the end cap 66, and the cap 66 is backed off (unscrewed) a short distance on its threads to make the connection tight. There may be included a vent hole 45, as discussed above with respect to FIGS. 3 and 4.

The sectional view of FIG. 7 shows a connecting rod 21 and a piston weight 19 inside the recoil reducer 11, as in FIGS. 2–4.

As FIGS. 6 and 7 indicate, the barrel ring 63 added onto the barrel 64 of the Ithaca-type shotgun is removably retained on the barrel. This is in part to facilitate removal of the barrel 64. The barrel ring 63 has a pair of legs 68 which extend up to the barrel 64 and are fastened by screws 69 to a block 71 secured to the underside of the barrel. When the barrel is to be removed from the gun, the screws 69 are removed, the barrel ring 63 is slid back, away from the block 71, the cap 66 is screwed down to disengage it from the take-down bracket 62, and the barrel is then rotated one-fourth turn and pulled out. This differs from the shotgun of FIGS. 1–4 (e.g., Remington 870 standard pump), wherein the barrel is removed by simply pulling it forward (after the recoil reducer 11 has been removed). Once the barrel 64 of the FIG. 6 shotgun has been removed, the recoil reducer 11 may be unscrewed and removed. Assembly is by the reverse procedure, and when the recoil reducer 11 has been installed it must be rotated to the correct position to align an opening 72 in a sleeve 73 of the recoil reducer with a gasport bore 74 from the barrel 64 and through the block 71 and the magazine tube 61. An indicating marker (not shown) on the exterior of the recoil reducer 11 may be provided to indicate proper rotational alignment.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. A recoil reducer for attachment to a shotgun having a barrel and a magazine tube below the barrel with a threaded forward end, comprising:

a cylinder tube comprising an extension for the forward end of the magazine tube, including a rearward-extending reinforcing sleeve of outside diameter sized to fit closely inside the shotgun's magazine tube, a forward extension connected to the sleeve, and threaded means on the exterior of the cylinder tube for engaging the threaded forward end of the magazine tube and securing the cylinder tube to the magazine tube such that the reinforcing sleeve extends into the magazine tube for stability of the cylinder tube and added strength for the magazine tube;

a slidable piston weight inside the cylinder tube, with means biasing it in the forward direction in the cylinder tube;

means forming an expansible chamber in the cylinder tube adjacent to the forward end of the piston weight;

gas conducting means for admitting pressurized gases generated upon the firing of a round in the shotgun, from the barrel to the expansible chamber to move the piston weight rearwardly against the biasing means;

whereby, when a round is fired in the shotgun, pressurized gases from behind the fired shot are admitted from the barrel to the expansible chamber in the cylinder tube, pushing the piston weight rearward and thereby recoiling the shotgun forward to partially offset the recoil from firing of the round.

2. The recoil reducer of claim 1, further including a rod attached to the piston weight and extending forward, and a forward slidable weight attached to the forward end of the rod, positioned in the forward extension of the cylinder tube, and including a fixed block in the cylinder tube between the two weights with a bore through which the rod is slidable, forming a wall of the expansible chamber, with the biasing means comprising a compression spring positioned around the rod and between the fixed block and the forward slidable weight to urge the forward slidable weight, the rod and the piston weight in the forward direction.

3. The recoil reducer of claim 2, wherein the gas conducting means comprises a barrel ring secured to the barrel of the shotgun and extending down therefrom and around the magazine tube, a gasport bore extending from the interior of the barrel ring to the interior of the gun barrel, and an opening through the top of the magazine tube and the aligned reinforcing sleeve, communicating with the expansible chamber.

4. The recoil reducer of claim 2, further including an end cap on the forward end of the cylinder tube, and a buffer just inside the cylinder tube, engaged against the cap, for cushioning the force of the forward slidable weight as it is returned forward by the spring.

5. The recoil reducer of claim 4, wherein the end cap and buffer have a vent opening for venting air to and from the cylinder tube when the forward slidable weight is returned forward by the spring.

6. The recoil reducer of claim 1, wherein the reinforcing sleeve and the forward extension of the cylinder tube are of the same inside diameter, and including stop means affixed to the inside surface of the cylinder tube for establishing a normal rest position for the piston weight, just rearward of the gas conducting means.

7. The recoil reducer of claim 6, further including a fixed block in the cylinder tube, spaced forward from the piston weight to define the expansible chamber.

8. The recoil reducer of claim 7, wherein the gas conducting means comprises a barrel ring secured to the barrel of the shotgun and extending down therefrom and around the magazine tube, a gasport bore extending from the interior of the barrel ring to the interior of the gun barrel, and an opening through the top of the magazine tube and the aligned reinforcing sleeve, the magazine tube and sleeve opening being located between the piston weight and the fixed block, in direct communication with the expansible chamber.

9. The recoil reducer of claim 1, wherein the piston weight comprises generally a hollow cylinder filled with lead.

10. The recoil reducer of claim 2, wherein the piston and the forward slidable weight each comprise generally a hollow cylinder filled with lead.

11. The recoil reducer of claim 1, wherein the gas conducting means comprises a barrel ring secured to the barrel of the shotgun and extending down therefrom and around the magazine tube, a gasport bore extending from the interior of the barrel ring to the interior of the gun barrel, and an opening through the top of the magazine tube and the aligned reinforcing sleeve, communicating with the expansible chamber.

12. The recoil reducer of claim 11, wherein the barrel ring is added on to the barrel of the shotgun, including a retention bracket secured to the underside of the barrel, conforming to the shape of the barrel and having a concave cylindrical lower side against which the upper exterior of the cylinder tube bears, a ring member slidably and closely received over the cylinder tube and having two legs extending up to the gun barrel and alongside the retention bracket, and threaded fastener means for securing the two legs of the ring member to the retention bracket.

13. The recoil reducer of claim 1, wherein the shotgun includes an existing magazine spring, normally urging stored cartridges rearward in the magazine, and wherein the magazine spring acts in compression between a stored cartridge and the slidable piston weight to help urge the piston weight in the forward direction, along with the biasing means.

* * * * *